US005174629A

United States Patent [19]

Mizushima

[11] Patent Number: 5,174,629

[45] Date of Patent: Dec. 29, 1992

[54] LUMBAR SUPPORT DEVICE

[75] Inventor: Yoshihiro Mizushima, Akishima, Japan

[73] Assignee: Tachi-S Co., Ltd., Tokyo, Japan

[21] Appl. No.: 794,415

[22] Filed: Nov. 19, 1991

[51] Int. Cl.[5] ..... A47C 3/00

[52] U.S. Cl. ..... 297/284.4

[58] Field of Search ..... 297/284 C, 264F F, 284 R, 297/460

[56] References Cited

U.S. PATENT DOCUMENTS

| | | | |
|---|---|---|---|
| 3,241,879 | 3/1966 | Castello et al. | 297/284 C |
| 3,807,794 | 4/1974 | Beyer | 297/284 C |
| 4,715,653 | 12/1987 | Hattori et al. | 297/284 C |
| 4,725,095 | 2/1988 | Benson et al. | 297/284 C |
| 4,886,316 | 12/1989 | Suzuyama et al. | 297/284 C |
| 4,896,918 | 1/1990 | Hoshihara | 297/284 C |
| 5,078,449 | 1/1992 | Suzuki | 297/284 C |

FOREIGN PATENT DOCUMENTS

| | | | |
|---|---|---|---|
| 3710466 | 10/1987 | Fed. Rep. of Germany | 297/284 C |

*Primary Examiner*—Jose V. Chen

*Attorney, Agent, or Firm*—Oldham, Oldham & Wilson LPA

[57] ABSTRACT

A lumbar support device including a generally L-shaped arm member supported rotatably upon a seat frame and a wire member of a torsion bar type, wherein one end of the arm member is operatively coupled to a drive mechanism and another end thereof is connected to one end of the wire member, wherein another end of wire member is provided with a lumbar support plate. Both arm and wire members are moved, without being projected, so that an unpleasant hard or pressing touch is avoided in the seat.

8 Claims, 3 Drawing Sheets

LUMBAR SUPPORT DEVICE

BACKGROUND OF THE INVENTION

1. Field of the Invention

The present invention relates to a lumbar support device provided within a seat back of an automotive seat, and in particular to a powered lumbar support device using an electric motor as a part of drive mechanism for causing movement of a lumber support member to support a lumbar part of an occupant on the seat.

2. Description of Prior Art

An example of hitherto powered lumbar support device is shown in FIG. 1. Its construction is such that a base bracket (11) is welded on a lateral part of a tubular seat back frame (1), with an electric motor (M) mounted to the base bracket (11) in parallel with the lateral part of seat back frame (1), and an arm (33″) is at its upper end connected pivotally to the upper end mounting part of base bracket (11) and at its lower end connected fixedly to the lumbar support plate (7), with the arrangement wherein the drive of the motor (M) causes a nut block (5) to move along a lead screw (4) through their threaded engagement. In this respect, specifically stated, the lead screw (4) stands vertically upon a gear box (B) connected to an output shaft (not shown) of motor (M), and is operatively connected with the motor (M) via the gear box (B) for rotation to cause vertical movement of the nut block (5) along the axial direction of lead screw (4). The nut block (5) is rotatably supported by a spindle (51′) which is journalled between the arm (33′) and auxiliary arm (3′). Those two arms (33′)(3′) are rotatably supported by a shaft (32′) fixedly journalled between the upper ends of base bracket (11). The free end of the arm (33′) is fixed to a horizontally extending rod (61′) from which a U-shaped lumbar spring wire (62′) extends to rotatably support the lumbar support plate (7).

With this structure, a drive of the motor (M) causes vertical movement of the nut block (5) along the lead screw (4) to simultaneously move those arm (33′), rod (61′), spring wire (62′) and lumbar support plate (7) altogether forwardly and backwardly relative to the seat back frame (1). Thus, it is possible to adjust the lumbar support force against the lumbar part of an occupant on the seat.

However, this prior-art lumbar support device has been found defective in the the relatively long arm (33′) is rotated about the axis (31′), resulting in the fact that the free end part of arm (33′) is moved along an arc of circle having a great radius relative to the center at (31′) and thus such arm free end part is projected excessively forwardly of the seat back frame (1) to give an unpleasant pressure to the back of the occupant. This is indeed true in view of an ordinary foam padding, which overlies that arm (33′) in question, being of a thin thickness, but to increase the thickness of padding at the lumbar support area will pose a less elastic layer before the lumbar support plate (7), thus making less effective the lumbar support workability.

SUMMARY OF THE INVENTION

It is a first purpose of the present invention to provide an improved lumbar support device which eliminates an unpleasant hard touch of mechanical elements of the device in the seat back.

To attain such purpose, a lumbar support device in the invention is of such a structure that a generally L-shaped arm member is rotatably supported on a seat frame and a wire member formed from a torsion bar is rotatably supported on the same frame, wherein the arm member has a first end connected to the wire member and a second end operatively coupled to a lead screw and nut mechanism which is driven by an electric motor, and wherein the wire member has a first wire section whose free end is connected to the first end of arm member and a second wire section extending inwardly of the seat frame and terminating in an end supporting a lumbar support plate.

Accordingly, in contrast to the prior-art arm member for moving the lumbar support plate, the L-shaped arm member is not projected to give a hard or pressing touch through seat back to an occupant sitting on the seat.

In one aspect of the invention, the first wire section is bent in a crank-like shape and the second wire section is bent from the first one at generally right angle to support the lumbar support plate. Thus, a slight rotation of the arm member turns out to be an amplified displacement of the lumbar support plate.

In another aspect of the invention, the first wire section, excepting its crank-like part, is rotatably supported by a support bracket having an elongated bush member therein. Since that portion of first wire section passes through the relatively long bush member, a great load applied to the first wire section is absorbed by the bush member, thus avoiding deformation of the support bracket.

DETAILED DESCRIPTION OF PREFERRED EMBODIMENTS OF THE INVENTION

Figure 1:
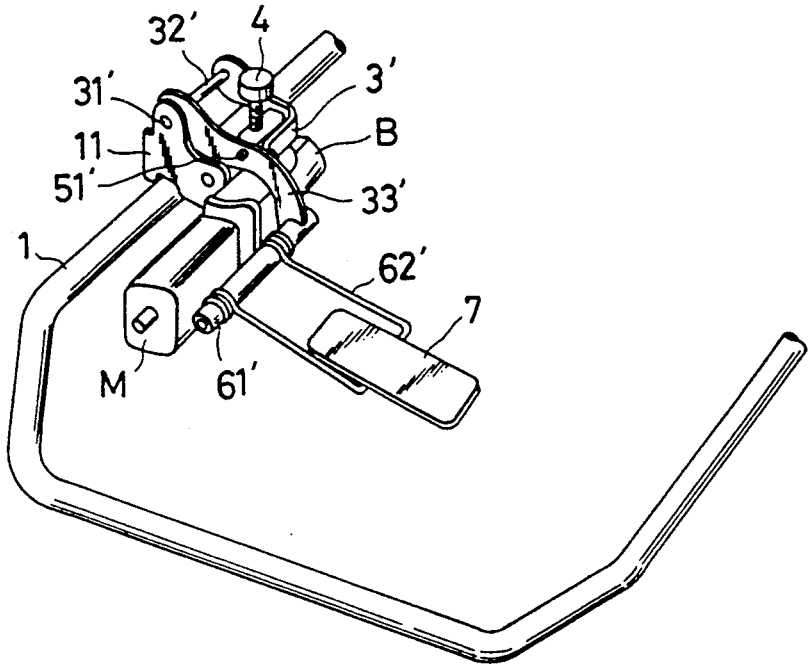
FIG.1 PRIOR ART
FIG. 1 is a perspective view of a conventional lumbar surface.
Figure 2:
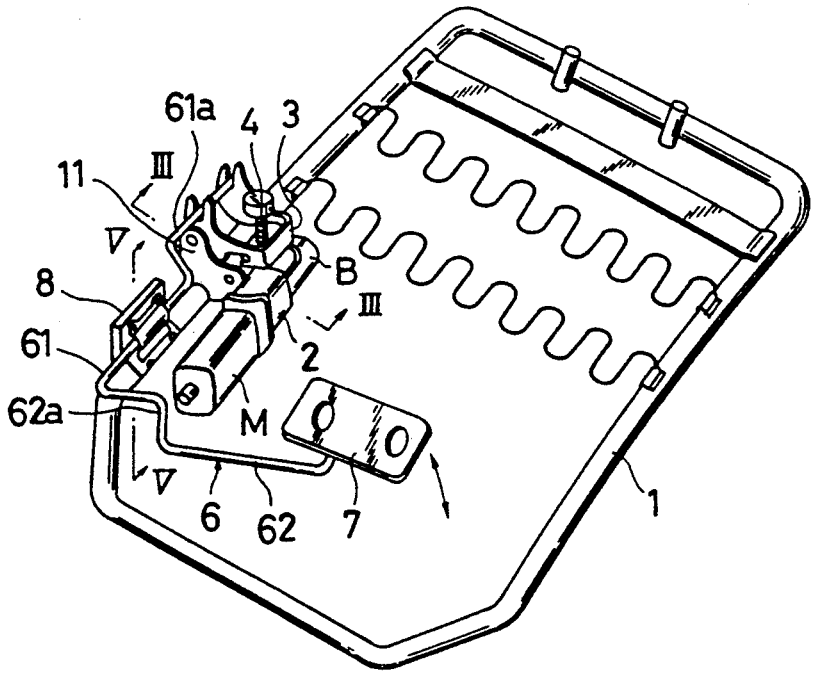
FIG. 2 is a perspective view of a lumbar support device in with the present invention.
Figure 3:
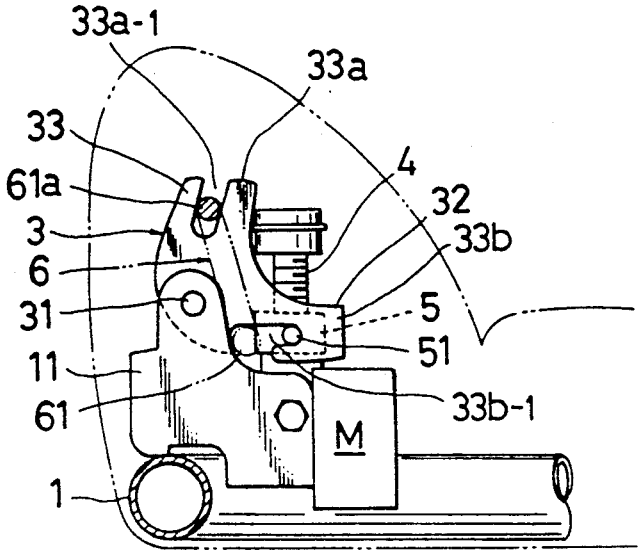
FIG. 3 is a sectional view taken along the line III—III in FIG. 2.
Figure 4:
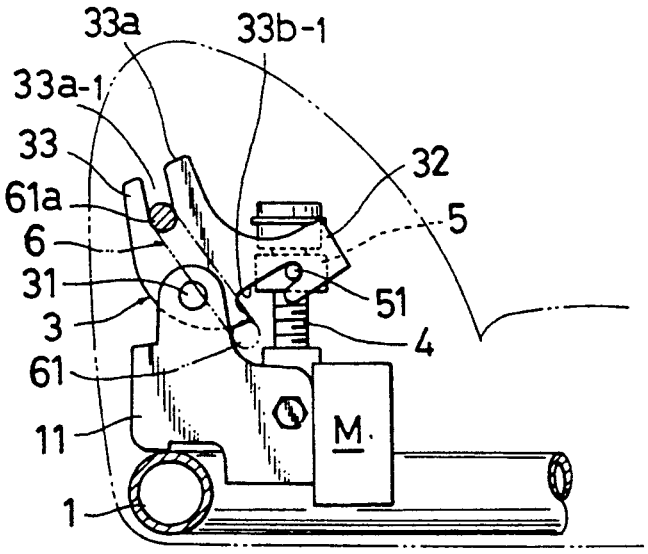
FIG. 4 a sectional view similar to FIG. 3, showing the state wherein an arm member is rotated counterclockwise.

Referring to FIGS. 2 to 4, there is illustrated a lumbar support device in accordance with the present invention. Since the present invention is directed to an improvement of the previously described prior-art lumbar support device, there are several common elements and mechanisms between them and therefore all like designations in the prior art description above correspond to all like designations in the present description. Specific explanation on such common portions is therefore deleted for the sake of simplicity in description.

According to the illustrated embodiment, there is utilized the basic lumbar support construction of the aforementioned prior art including the seat back frame (1), base bracket (11), motor (M), gear box (B), nut block (5), lead screw (4) and lumbar support plate (7), but with particular reference to FIGS. 2 and 3, it is seen that, in the present invention, a generally U-shaped arm member (3), a wire arm (6) with an unique configuration, which operatively connects the arm member (3)

with the lumbar support plate (7), and a support bracket (3) supporting the wire arm (6) are arranged in the prior-art lumbar support structure.

The generally U-shaped arm member (3) comprises a pair of lateral arm sections (33)(33) each having a generally L-shaped form, as best seen from FIG. 3, in which are defined an upwardly projected part (33*a*) and a lower horizontal part (33*b*), and an intermediate arm section (32) defined between the two lateral arm sections (33)(33). In each of lateral arm sections (33)(33), the upwardly projected part (33*a*) and lower horizontal part (33*b*) are respectively formed with an upper engagement slit (33*a*-1) and a lower engagement slit (33*b*-1). Thus-formed arm member (3) are at its curved corner portion supported rotatably upon the shaft (31), such that arm member is rotatable about the shaft (31) freely. Into the lower engagement slit (33*b*-1), the pin (51) integral with the nut block (5) is slidably inserted, whereas in the upper engagement slit (33*a*-1), a crank wire section (61*a*) of wire arm (6) is received slidably.

Reference being made again to FIG. 2, there is shown, in the perspective, an entire formation of the wire member (6) of generally L-shaped configuration including a first wire section (61) disposed along the longitudinal direction of left-side lateral frame section of seat back frame (1) and a second wired section (62) extending generally at a right angle from the first one (61) in a direction inwardly of the seat back frame (1). As shown, the first wire section (61) terminates in the foregoing crank wire section (61*a*) which is slidably received in and passing through both two upper engagement slits (33*a*-1) associated with the arm member (3). The first wire section (61) per se is rotatably supported by the support bracket (8) fixed on the right-side lateral section of seat back frame (1). The second wire section (62) is bent at (62*a*) in the downward direction and extends inwardly of the frame (1), terminating in a support portion (not shown) on which is mounted the lumbar support plate (7). Preferably, the wire member (6) is made of a rigid metallic wire, with its second section (62) being provided with a spring nature having a certain elastic property.

It is to be noted that the disposition of the crank wire section (61*a*) is generally in a relation orthogonal relative to the second wire section (62), for a purpose to be set forth later.

With the structure described above, a switch operation for drive of the motor (M) causes vertical movement of the nut block (5) to rotate the arm member (3) about the shaft (31) in the clockwise or counterclockwise direction, which in turn causes the rotation of the crack wire section (61*a*) to thereby rotate the first wire section (61) about its axis in a corresponding direction. This axial rotation simultaneously rotates the second wire section (62) about the axis of the first wire section (61) in the same direction. Thus, the lumbar support plate (7) is rotated forwardly and backwardly with respect to the seat back frame (1) in an adjustable way through a control of the motor (M).

Accordingly, in accordance with the present invention, as can be seen from FIGS. 3 and 4, the upwardly projected part (33*a*) of arm member (3) is merely rotated about the point (31) without projecting excessively to press a padding within the seat back and likewise the opposite horizontal part (32) of arm member (3) is limited its raising level within the height of lead screw (4) by virtue of the associated pin (51) being raised and lowered within the threaded part of lead screw (4). This slight movement is in no way felt by a person who leans his or her back against the seat back. Further, it is appreciated that, because of the foregoing configuration of wire arm (6), a small degree of rotation of the crank wire section (61*a*) leads on an amplified rotation of the lumbar support plate (7), which saves the range in which the upwardly projected part (33*a*) and lower horizontal part (33*b*) of arm member (3) is projected outwardly within the seat back, thereby adding to the effectiveness for preventing a person from being felt by a hard touch of those elements.

Figure 5:
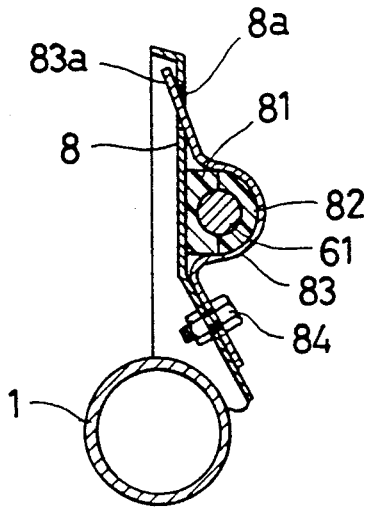
FIG. 5 is a sectional view taken along the line V—V in the 2.
Figure 6:
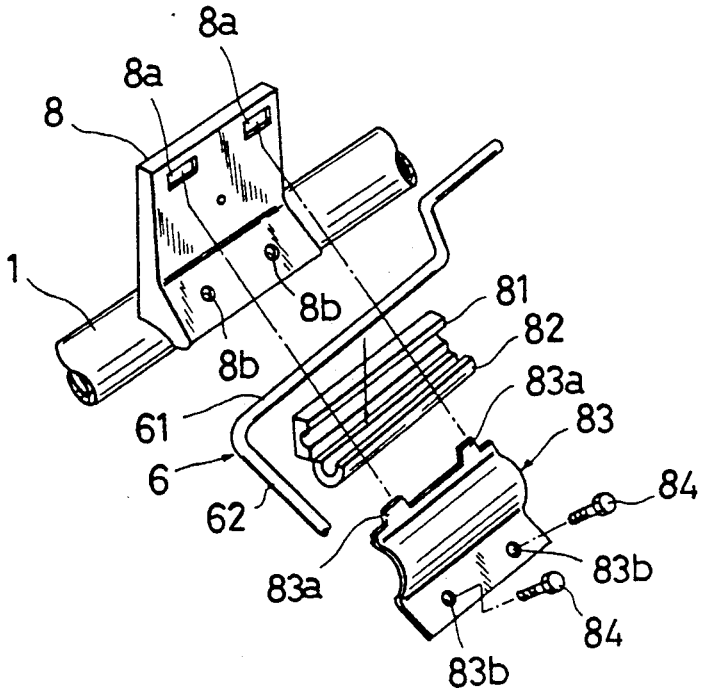
FIG. 6 is an exploded, perspective view of a support bracket for supporting a wire member.

FIGS. 5 and 6 show the construction of the support bracket (8). The support bracket (8) is welded fast on the lateral frame section of seat back frame (1). In the upper end portion of the bracket (8), a pair of spaced-apart through-holes (8*a*)(8*a*) are formed, while in the lower base portion of same, a pair of spaced-apart holes (8*b*)(8*b*) are formed. Designation (83) denotes a semicircular shaped securing bracket having a pair of securing lugs (83*a*) (83*a*) formed at one edge thereof in correspondence with the foregoing pair of through-holes (8*a*)(8*a*), as well as a flat flange part having a pair of holes (83*b*)(83*b*) formed therein. As shown in FIG. 5, there is interposed a split bush member (81, 82) between the main and securing brackets (8)(83), the split bush member (81, 82) being of elongated cylindrical shape, having a through-bore (81*a*) formed therein. As understandable from FIG. 6, the first wire section (61) of wire member (6) is covered with such bush member (81,82), and then the bush member (81, 82) is firmly retained between the main and securing brackets (8)(83) by firstly inserting the two lugs (83*a*)(83*a*) of securing bracket (83) into the two through-holes (8*a*)(8*a*) of main bracket (8) and then securing together the main and securing brackets (8)(83) by means of two fixing screws (84) (84). This bush arrangement helps to reinforce the brackets (8, 83) against deformation; namely, even if a load is applied to the wire member (6), the the first wire section (61) thereof is resiliently blocked by the bush member (81, 82), with the result that no great load is applied to both brackets (8, 83), thus effectively preventing the brackets against deformation.

The present invention is not limited to the illustrated embodiments, but any other modifications, replacements and additions may structurally be possible without departing from the spirit and scope of the appended claims.

What is claimed is:

1. A lumbar support device, which includes an electric motor fixed on a seat frame, a lead screw operatively connected with said electric motor, a nut block in threaded engagement with said lead screw, an arm means operatively coupled to said nut block and a lumbar support plate provided at a free end of said arm means, such that a drive of said motor causes vertical movement of said nut block along said lead screw so as to simultaneously move said arm means, thereby displacing said lumbar support plate forwardly and backwardly relative to said seat frame, characterized in that the said arm means comprises:

1) an arm member rotatably supported upon said seat frame such as to be rotatable about a longitudinal axis of said seat frame, and operatively connected to said nut block so that vertical movement of said nut block causes said arm member to rotate, and 2) a wire member operatively connected to said arm member, said wire member comprising a first wire section which extends along a lower part of said seat frame and is operatively connected to said arm member so that said wire member rotates as said arm member rotates, and a second wire section which extends inwardly from said seat frame and terminates in a free end, said lumbar support plate being supported at said free end of said second wire section, whereby said lumbar support plate is rotated forwardly and backwardly with respect to the seat back frame as said wire member rotates.

2. The lumbar support device according to claim 1, wherein a base bracket is fixed on said seat frame, having a shaft extending along a longitudinal direction of said seat frame, and wherein said arm member is pivotally supported on said shaft in a rotatable manner.

3. The lumbar support device according to claim 1, wherein said arm means comprises a generally U-shaped configuration having a pair of generally L-shaped lateral portions, which is so disposed as to surround said lead screw and nut block, and wherein said pair of generally L-shaped lateral portions are each formed with first end and second end, such that said first end extends outwardly to receive said first wire section slidably and said second end extends inwardly of said seat frame to be pivotally connected with said nut block, with an intermediate part of said lateral portions defined between said first and second sections being pivotally supported upon said seat frame.

4. The lumbar support device according to claim 1, wherein said first wire section of said wire member is formed in a crank shape and wherein said second wire section thereof is bent from said first wire section generally at a right angle, extending in a direction inwardly of said seat frame.

5. The lumbar support device according to claim 4, wherein said second wire section is bent at its base part in a direction backwardly of said seat frame and further bent in said direction inwardly of said seat frame, terminating in said means for supporting said lumbar support plate.

6. The lumbar support device according to claim 1, wherein a support means is fixed on said seat frame for supporting said first wire section of said wire member via a bush member of an elongated cylindrical form therein, to thereby prevent deformation of said first wire section.

7. The lumbar support device according to claim 6, wherein said support means comprises a main bracket welded on said seat frame, and a semi-circular securing bracket, wherein said bush member is securely sandwiched between said main bracket and securing bracket, and through said bush member, there extends said first wire section of said wire member in a rotatably way.

8. The lumbar support device according to claim 1, wherein said wire member is made of rigid metallic wire.

* * * * *